US005574337A

United States Patent [19]

Dunsmore

[11] Patent Number: 5,574,337

[45] Date of Patent: Nov. 12, 1996

[54] SINGLE TOUCH FLASH CHARGER CONTROL

[75] Inventor: Clay A. Dunsmore, Fairport, N.Y.

[73] Assignee: Eastman Kodak Company, Rochester, N.Y.

[21] Appl. No.: 330,658

[22] Filed: Oct. 28, 1994

Related U.S. Application Data

[63] Continuation-in-part of Ser. No. 327,244, Oct. 21, 1994, which is a continuation-in-part of Ser. No. 269,415, Jun. 30, 1994.

[51] Int. Cl.[6] ..... H05B 37/00

[52] U.S. Cl. ..... 315/241 P; 315/241 R; 315/239; 315/219; 396/202; 396/6

[58] Field of Search ..... 315/241 P, 209 R, 315/219, 221, 239, 241 R; 354/145.1, 127.11, 418, 147, 288, 76

[56] References Cited

U.S. PATENT DOCUMENTS

| | | | |
|---|---|---|---|
| 2,933,027 | 4/1960 | Hollingworth et al. | 95/31 |
| 3,310,723 | 3/1967 | Schmidt et al. | 320/1 |
| 3,651,372 | 3/1972 | Uchida et al. | 315/134 |
| 3,731,586 | 5/1973 | Meazza | 88/1.5 R |
| 3,764,849 | 10/1973 | Ohta | 315/241 P |
| 3,780,344 | 12/1973 | Paget | 315/241 P |
| 3,859,563 | 1/1975 | Vogt | 315/241 P |
| 3,882,358 | 5/1975 | Deskevich et al. | 315/241 P |
| 4,001,640 | 1/1977 | Biber | 315/241 P |
| 4,007,469 | 2/1977 | Land et al. | 354/27 |
| 4,065,700 | 12/1977 | Liebman | 315/241 R |
| 4,067,028 | 1/1978 | Lermann et al. | 354/141 |
| 4,082,983 | 4/1978 | Adams, Jr. | 315/241 P |
| 4,084,167 | 4/1978 | Iwata | 354/33 |
| 4,130,780 | 12/1978 | Ban et al. | 315/241 P |
| 4,163,178 | 7/1979 | Hosono | 315/241 P |
| 4,259,615 | 3/1981 | Kashihara et al. | 315/241 P |
| 4,271,375 | 6/1981 | Hosono | 315/241 P |
| 4,322,143 | 3/1982 | Mailander | 354/32 |
| 4,323,822 | 4/1982 | Yakematsu | 315/241 P |
| 4,348,087 | 9/1982 | Ellin et al. | 354/139 |
| 4,404,497 | 9/1983 | Takematsu | 315/241 P |
| 4,511,233 | 4/1985 | Kazami et al. | 354/418 |
| 4,523,248 | 6/1985 | Schmale et al. | 315/241 P X |
| 4,540,265 | 9/1985 | Harvey | 354/417 |
| 4,628,229 | 12/1986 | Inoue | 315/241 P |
| 4,777,507 | 10/1988 | Dunsmore et al. | 354/418 |
| 4,812,863 | 3/1989 | Ohmura et al. | 354/219 |
| 4,812,866 | 3/1989 | Ushiro et al. | 354/288 |
| 4,855,774 | 8/1989 | Ohmura et al. | 354/203 |

(List continued on next page.)

FOREIGN PATENT DOCUMENTS

| | | |
|---|---|---|
| 0398526 | 11/1990 | European Pat. Off. . |
| 2470515 | 5/1981 | France . |
| 2430481 | 1/1975 | Germany . |
| 3347488 | 7/1984 | Germany . |
| 3-65129 | 6/1991 | Japan . |
| 5-93951 | 4/1993 | Japan . |
| 6-43525 | 2/1994 | Japan . |
| 6-130469 | 5/1994 | Japan . |
| 6-208897 | 7/1994 | Japan . |
| 6-202208 | 7/1994 | Japan . |
| 6-203987 | 7/1994 | Japan . |
| 6-203988 | 7/1994 | Japan . |
| 6-203989 | 7/1994 | Japan . |
| 2133644 | 7/1984 | United Kingdom . |

*Primary Examiner*—Robert Pascal
*Assistant Examiner*—Haissa Philogene
*Attorney, Agent, or Firm*—Francis H. Boos, Jr.

[57] ABSTRACT

An electronic flash device including a self-oscillating charging circuit, a momentary trigger for initiating oscillations of the circuit to charge a flash capacitor, and a voltage sensing device coupled directly between the circuit and the flash capacitor for arresting the oscillations when the capacitor is fully charged. The voltage sensor includes a zener diode in series with a neon ready-light, and switches on a transistor to ground the charging circuit and arrest the oscillations when the capacitor is fully charged. Actuation of the flash device automatically restarts the oscillations and recharges the flash capacitor. A process for recycling a single use camera having such an electronic flash device also is disclosed.

28 Claims, 6 Drawing Sheets

U.S. PATENT DOCUMENTS

| | | | |
|---|---|---|---|
| 4,884,087 | 11/1989 | Mochida et al. | 354/75 |
| 4,890,130 | 12/1989 | Takei et al. | 354/288 |
| 4,912,499 | 3/1990 | Desormeaux | 354/468 |
| 4,924,149 | 5/1990 | Nishida et al. | 315/241 P |
| 4,989,029 | 1/1991 | Inoue et al. | 354/418 |
| 4,994,846 | 2/1991 | Kobayashi et al. | 354/418 |
| 5,019,845 | 5/1991 | Asakura et al. | 354/149.1 |
| 5,021,811 | 6/1991 | Maurinus et al. | 354/76 |
| 5,068,575 | 11/1991 | Dunsmore et al. | 315/241 P |
| 5,101,335 | 3/1992 | Ludden et al. | 315/241 P X |
| 5,138,362 | 8/1992 | Kobayashi et al. | 354/418 |
| 5,170,199 | 12/1992 | Nakai et al. | 354/126 |
| 5,249,007 | 9/1993 | Tanaka | 354/145.1 |
| 5,255,041 | 10/1993 | Lyon et al. | 354/288 |
| 5,287,134 | 2/1994 | Cocca | 354/132 |
| 5,315,332 | 5/1994 | Hirasaki et al. | 354/149.11 |
| 5,329,330 | 7/1994 | Sakai et al. | 354/288 |
| 5,337,099 | 8/1994 | Tasaka et al. | 354/76 |
| 5,353,165 | 10/1994 | VanDeMoere et al. | 359/819 |

SINGLE TOUCH FLASH CHARGER CONTROL

CROSS-REFERENCE TO RELATED APPLICATIONS

This application is a continuation-in-part of U.S. patent application Ser. No. 08/327,244 filed Oct. 21, 1994 which is a continuation-in-part of U.S. patent application Ser. No. 08/269,415 filed Jun. 30, 1994. The ornamental aspects of features of the single use camera illustrated in FIGS. 3–7 are subjects of the following copending design applications commonly assigned with the present application: Flash Camera with Cover Label, Ser. No. 29/027,928; Flash Camera, Ser. No. 29/027,930; Cover Label for Flash Camera, Ser. No. 29/027,933, all of which were filed on Sep. 1, 1994; and Rear Cover of Flash Camera, Ser. No. 29/029,992, filed on Oct. 20, 1994. Other features of the single use camera illustrated in FIGS. 3–7 are subjects of the following utility applications commonly assigned with the present applications and filed simultaneously herewith: Anamorphic Lens For A Photographic Flash Assembly, Ser. No. 08/327,089; and One Piece Viewfinder And Fabrication Process, Ser. No. 08/330,572.

BACKGROUND OF THE INVENTION

1. Field of Invention

The invention relates to electronic flash devices having particular utility with low cost photographic cameras, and more specifically to charging and charge-control circuits for such flash devices.

2. Description of the Prior Art

Electronic flash devices typically include capacitors that are charged from a battery and discharged through a gas-filled flash tube. Energy from the discharging capacitor excites the gas, which illuminates the scene.

Design considerations usually involve a balance between a reasonably long battery life and the desire for rapid and continuous charging of the capacitor. In multiple use cameras this balance frequently is resolved in favor of continuous or automatically recycled charging whenever the flash is in a ready mode. If the battery is drained, there may be some inconvenience, but it is replaceable. In single use cameras, on the other hand, the batteries are seldom accessible for replacement. Elimination of undue battery drain is particularly important, even in the ready mode. Usually the operator is required to maintain continuous pressure on a biased switch. Charging stops when the switch is released, saving the battery.

One example of a recent approach for balancing the above-mentioned considerations is depicted in Konica Japanese Publication No. 3-65129U. A photographic camera is disclosed with an electronic flash device that has a charging cycle initiated by one switch and arrested by another switch. Momentary depression of the first switch energizes a self-oscillating charging circuit which continues charging after the momentary switch is released. An inductive coupling and capacitive timing circuit are used to activate the second switch and arrest the oscillations several seconds after recharging is completed. A ready lamp is coupled across the flash capacitor for visually indicating when the device has sufficient charge for satisfactory operation.

Although prior flash devices offer many advantages, the present invention addresses problems that remain, particularly in connection with low cost charging circuits and single use cameras. Continuous pressure on a biased switch may save the battery, but it also requires the operator's attention, which might better be directed to scene composition. Even in cameras having replaceable batteries, replacement is inconvenient and often is required in the middle of a transient photographic event.

The solution proposed in the above-mentioned publication offers unattended charging and automatic shut-off, but relies on indirect inductive coupling and a capacitive timing circuit. Tolerance variability in such components and circuits is not conducive to reasonably precise yet inexpensive charge control. Temperature changes effect circuit characteristics and degrade performance. Closely controlled operation with a ready light also is difficult, since the ready light works directly off the capacitor, while the shut-off control is inductively coupled.

SUMMARY OF THE INVENTION

The present invention is directed to overcoming one or more of the problems set forth above. Briefly summarized, according to one aspect of the invention, an electronic flash device is provided with a self-oscillating charging circuit, a momentary trigger for initiating oscillations of the circuit to charge a flash capacitor, and a voltage sensing device coupled directly between the circuit and the flash capacitor for arresting the oscillations when the capacitor is fully charged. According to more specific features of the invention, the voltage sensor includes a zener diode, or a zener diode in series with a neon ready-light. Still more specifically, a voltage sensor, including a zener diode and neon ready light, switches a transistor gate for grounding the charging circuit to arrest the oscillations when the capacitor is fully charged.

According to another feature of the invention, a flash device with a self-oscillating charging circuit, and an oscillation arresting circuit, is provided with a feedback loop for reinitiating oscillations in the circuit in response to actuation of the flash.

Still another feature of the invention uses a neon ready light for several functions. According to one function, the ready light conducts when the flash capacitor voltage exceeds a ready voltage to indicate when the voltage is sufficient to initiate an exposure. In another function, the ready light serves as a component in a voltage sensing trigger circuit that stops charging of the flash capacitor when it reaches a predetermined voltage greater than the ready voltage. More specifically, the neon light is part of first and second electrical loops. The first loop conducts continuously when the capacitor charge is above the ready charge. The second loop controls the charging circuit and conducts momentarily to trigger the charging circuit off when the capacitor charge reaches the predetermined charge. The momentary conduction momentarily increases the illumination of the ready light and indicates when the predetermined charge is attained.

The invention further includes a feature that filters oscillations in the charging circuit to dampen oscillations caused by battery bounce, and the like, so they do not restart charging of the flash capacitor, but permits such a restart when energy is released to fire the flash.

Still another feature of the invention is a method of making a single use camera, including an electronic flash, from previously used single use camera parts. According to the method, a camera body is provided having a film cassette chamber; previously used single use camera parts are supported in the body, including features as recited above; and an unexposed roll of film is loaded into the film cassette chamber.

The invention permits the use of a momentary switch for initiating charging, with an automatic and controlled shut-off that conserves battery life. It offers particular advantages when combined in, or for use with, inexpensive cameras such as single use cameras. Since the voltage sensing device is coupled directly to the flash capacitor, without intervening inductive or capacitive devices, tolerances can be reasonably precise with inexpensive components. Temperature effects are minimal. The invention is simple, yet effective. It permits concentration by the operator on the photographic event, while assuring accurate charging of the flash device with minimal battery drain.

Another aspect of the invention is to provide a single use electronic flash camera that may incorporate previously used elements in a recycled camera, including a camera body having a film cassette chamber. The ability to recycle parts promotes the efficient use of scarce natural resources, saves space in landfills, and reduces the cost of camera. To this end, the camera body supports single use camera parts, including an electronic flash device having a capacitor, self-oscillating charging circuit coupled to the capacitor for charging the capacitor, and a trigger connected to the self-oscillating charging circuit which, when momentarily closed, initiates oscillations in the self-oscillating charging circuit. The oscillations in the charging circuit continue when the trigger is open and a switch is operable to arrest the oscillations. A voltage sensor is coupled between the switch and capacitor and is responsive to the voltage on the capacitor for activating the switch to arrest the oscillations when the capacitor is fully charged. Many single use camera parts, including the flash device, may be recycled in any particular camera. An unexposed roll of film then is mounted in the film cassette chamber of the camera body.

Still another feature of the invention is to provide a method of recycling a single use camera with an electronic flash by incorporating previously used single use camera parts comprising the steps of: providing a previously used camera body having a film cassette chamber; supporting in the camera body previously used single use camera parts, including an electronic flash device having a capacitor, a self-oscillating charging circuit coupled to the capacitor for charging it, a trigger connected to the self-oscillating circuit which, when momentarily closed, initiates oscillations in the self-oscillating charging circuit, the oscillations continuing when the trigger is opened, a switch operable to arrest the oscillations, and a voltage sensor coupled between the switch and the capacitor for activating the switch to arrest the oscillations when the capacitor is fully charged; and loading an unexposed roll of film into the film cassette chamber of the camera body.

These and other features and advantages of the invention will be more clearly understood and appreciated from a review of the following detailed description of the preferred embodiments and appended claims, and by reference to the accompanying drawings.

DESCRIPTION OF THE PREFERRED EMBODIMENTS

Figure 1:
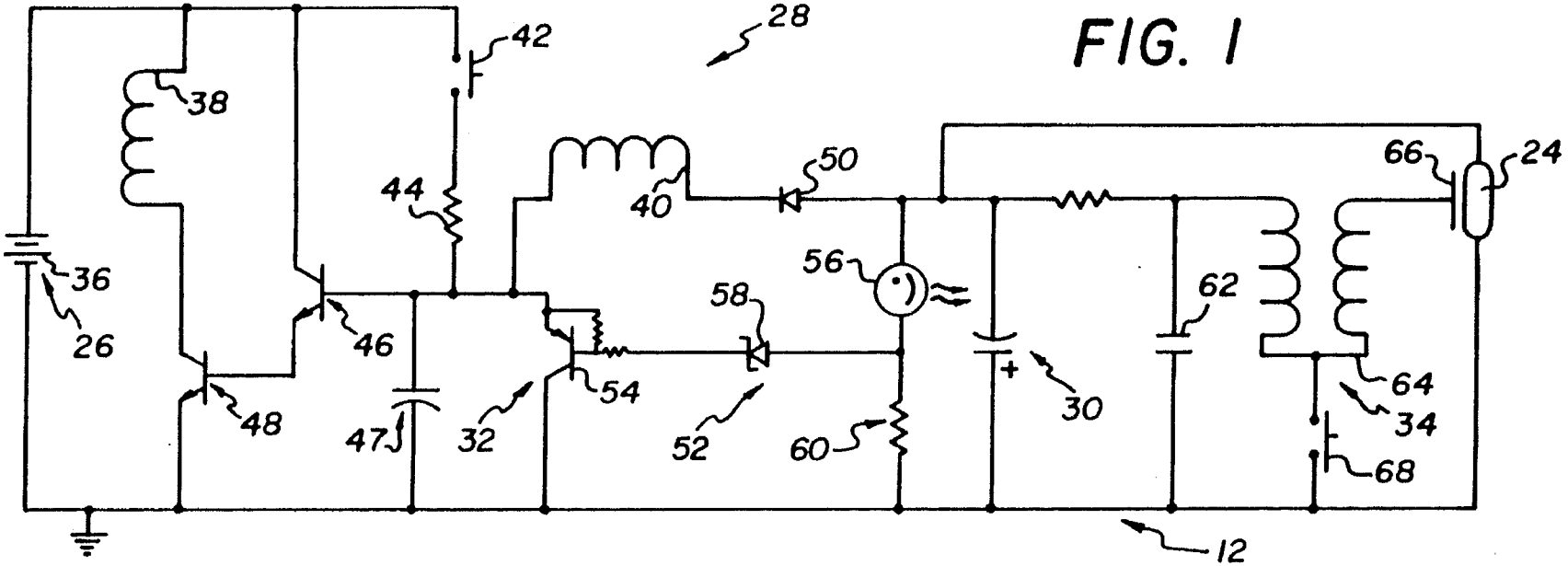
FIG. 1 is a schematic view of a flash charging and control circuit in accordance with a preferred embodiment of the invention.
Figure 2:
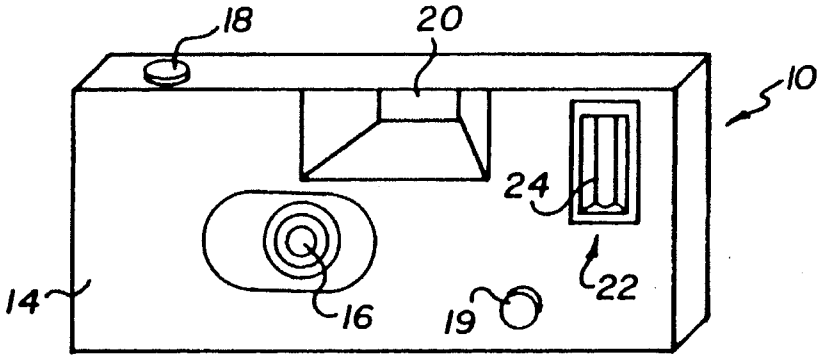
FIG. 2 is a perspective view of a camera including the flash charging and control circuit of FIG. 1.

Referring now to the drawings, a preferred embodiment of the invention is depicted in an inexpensive, single use camera 10 (FIG. 2) with a flash charging and control circuit 12 (FIG. 1). The camera includes a body 14, an optical system 16, two actuating mechanisms 18 and 19, a viewfinder 20 and a flash device 22 including a flash tube 24. The camera body 14 is adapted to receive and locate photographic film in a predetermined exposure position relative to the other camera components. Actuating mechanism 18 initiates a sequence which exposes the film through optical system 16 with supplemental illumination from flash device 22. Activating mechanism 19 initiates a flash charging cycle prior to the exposure sequence. The camera is pointed at the intended subject with the aid of viewfinder 20.

In this preferred embodiment, operation of the flash device 22 is selected by the user, when needed, by momentary depression of a separate activating mechanism 19. Other approaches might be employed, however, including flash actuation with every exposure, which is typical of some single use cameras that have few and inexpensive components. Also included within the scope of the invention are single multi-stage actuation buttons and switches for sequentially initiating the charging and exposure cycles.

The flash charging and control circuit 12 includes a direct current power source 26, a self-oscillating flash charging circuit 28, a charge storage device in the form of a capacitor 30, an oscillation arresting circuit 32, a flash trigger circuit 34 and the flash tube 24.

Power source 26 includes one or more batteries 36 of predetermined voltage, supplied with the camera in this preferred embodiment and without provision for replacement.

The self-oscillating charging circuit 28 includes a voltage converting transformer having primary and secondary windings 38 and 40, respectively; a momentary switch 42, for initiating oscillations in the circuit 28; a resistor 44 in series with the momentary switch; ganged transistors 46 and 48, acting as switching elements for supporting and maintaining the oscillations; and a diode 50 for rectifying current induced in the secondary windings 40 of the transformer.

Charging is initiated by momentary depression of activating mechanism 19 which closes the momentary switch 42, thereby establishing current flow through resistor 44, transistors 46 and 48 and primary transformer winding 38. The switch 42 connects the base of transistor 46 to battery 26 through resistor 44. Current flowing from the battery into the base of transistor 46 is multiplied by a transistor gain of fifty (50) and flows to the base of transistor 48. The current is multiplied again at transistor 48, with a gain of two hundred (200), and flows through the collector of transistor 48 and transformer primary winding 38. As the current flow builds in primary winding 38, it inductively induces current flow in secondary winding 40. Current flows out of capacitor 30, charging the capacitor, and into the base of transistor 46, providing positive feedback.

At some point the base feedback will no longer support increasing current and the process reverses. Reduced primary current results in less feedback current, which means less primary current, etc., completing the first micro cycle. The next micro cycle is started by noise in the base of transistor 46 caused by the changing field in secondary 40. Another micro cycle is started, and oscillations continue. Transistors 46 and 48 provide enough loop gain to sustain the oscillations whether momentary switch 42 is open or closed.

Oscillations in the primary transformer windings 38 induce current in the secondary windings 40. Capacitor 30 is charged by the current flow, which is in one direction through rectifying diode 50 toward transistor 46.

Oscillation arresting circuit 32 includes a voltage sensor 52 and a digital pnp transistor or gate 54. The voltage is sensed by a neon ready light 56 in series with a zener diode 58. The neon ready light begins conducting at two hundred seventy volts (270 v.), but the voltage drop across the ready light falls to two hundred and twenty volts (220 v.) when it is conducting. The zener diode breaks down and conducts at one hundred ten volts (110 v.). The voltage sensor 52, which includes the ready light 56 and zener diode 58 in series, begins conducting at three hundred thirty volts (330 v.), which also represents a predetermined or full charge desired on flash capacitor 30. As used in this specification, the term full charge on the flash capacitor is used to mean that charge or voltage desired for application to the flash when it is fired.

When the voltage across capacitor 30 reaches two hundred seventy volts (270 v.), neon ready light 56 begins to conduct, illuminating the ready light and providing notification to the user there is sufficient charge on flash capacitor 30 to initiate the exposure sequence. The capacitor 30 is not fully charged, however, and charging continues until the charge on capacitor 30 reaches three hundred thirty volts (330 v). When the flash capacitor 30 is fully charged, zener diode 58 begins to conduct, applying current to the base of transistor 54, switching transistor 54 on, and grounding the self-oscillating charging circuit 28. Oscillations in the circuit are arrested, and charging stops.

The neon ready light serves several functions. It conducts when the flash capacitor voltage exceeds a ready voltage to indicate when there is sufficient charge on the capacitor to initiate an exposure. It also serves as a component in a voltage sensing trigger circuit that stops charging of the flash capacitor when it reaches a predetermined or full voltage greater than the ready voltage. This permits the use of a zener diode rated for a lower voltage in the voltage sensing circuit without requiring any additional parts. The neon light is part of two electrical loops, each serving the different functions. The first loop includes the capacitor 30, the ready light 56 and resistor 60. This loop conducts continuously when the capacitor charge is above the ready charge, turning the ready light on. The second loop includes the capacitor 30, the ready light 56, the zener diode 58, and the transistor gate 54. This loop controls the charging circuit and conducts momentarily to trigger the charging circuit off when the capacitor charge reaches the predetermined or full charge. The momentary conduction momentarily increases the illumination of the ready light and thereby indicates when the predetermined charge is attained.

According to this preferred embodiment, the voltage sensing circuit 52 is the neon ready light in series with the zener diode. Other components could be used, however, according to certain features of the invention. The neon light and zener diode act as a trigger for actuating transistor gate 54, and define a signal path between the flash capacitor 62 and the transistor 54. Other components that might be substituted for the diode and light include components that transmit signals by conducting electrons or transmitting photons.

Resistor 44, which is sized small enough to provide current to start the oscillations, is large enough for the digital transistor 54 to stop the oscillations even with momentary switch 42 still closed.

The flash triggering circuit 34, is used in commercially available single use cameras, and will not be described in detail. Briefly, the circuit 34 includes a triggering capacitor 62, a voltage converting transformer 64, a flash triggering electrode 66 and a synchronizing switch 68. Triggering capacitor 62 is charged by current flow through secondary winding 40 at the same time and in similar manner as flash capacitor 30. In operation, synchronizing switch 68 is closed by the camera shutter mechanism at the proper time in the exposure sequence. Capacitor 62 discharges through the primary windings of voltage converting transformer 64, inducing four thousand volts (4 kv.) in triggering electrode 66, and ionizing the gas in flash discharge tube 24. Flash capacitor 30 then discharges through the flash tube 24, exciting the gas and producing flash illumination.

It should now be apparent that an oscillation arresting device according to the present invention is coupled directly through a voltage sensor to the flash capacitor, and is not ratioed through inductive components or timed with capacitive circuits. Inexpensive components provide relatively precise charging control automatically to reduce undue battery drain and free the user for photographic composition. The phrase "direct coupling," as used in the present specification and claims, is intended to cover primarily resistive couplings, including neon lights and zener diodes, but excluding those that are primarily inductive or capacitive.

According to another feature of the invention, and the preferred embodiment already described, the flash charging cycle is reinitiated automatically by actuation of the flash device. Energy transitions in the flash triggering and discharge circuits 30, 34 and 62, acting through secondary winding 40, generate noise in the base of transistor 46. The feedback loop, including transistors 46 and 48, again provide enough loop gain to sustain the oscillations whether momentary switch 42 is open or closed. The self-oscillating charging cycle is restarted, and the oscillations continue as before.

A capacitor 47 provides filtering on the base of transistor 46 to keep the circuit from inadvertently turning on due to undesirable noise from, for example, battery bounce or the neon ready light 56 turning off. Capacitor 47 preferably has a value of 470 pico farads in order that the aforedescribed feedback loop can overcome the effect of capacitor 47 to restart the self-oscillating charging cycle. In the illustrated and preferred circuit of FIG. 1, values of capacitor 47 might range from two hundred pico farads (200 pf) to one thousand pico farads (1000 pf). A value of six thousand eight hundred pico farads (6800 pf) was tried and is considered too high, according to this feature, because it prevents reinitiation of the charging sequence when the flash is fired. Of course the capacitor 47 might have other values according to other aspects of the invention.

Referring now to FIGS. 3–7, the flash charging and control circuit 12 can be contained within the assemblage of a camera, such as a recyclable single use camera 100 having three major structural components; a main body or frame 102, a front cover 120 which is attached to the front of the body, and a rear cover 130 which is attached to the rear of the body.

Figure 3:
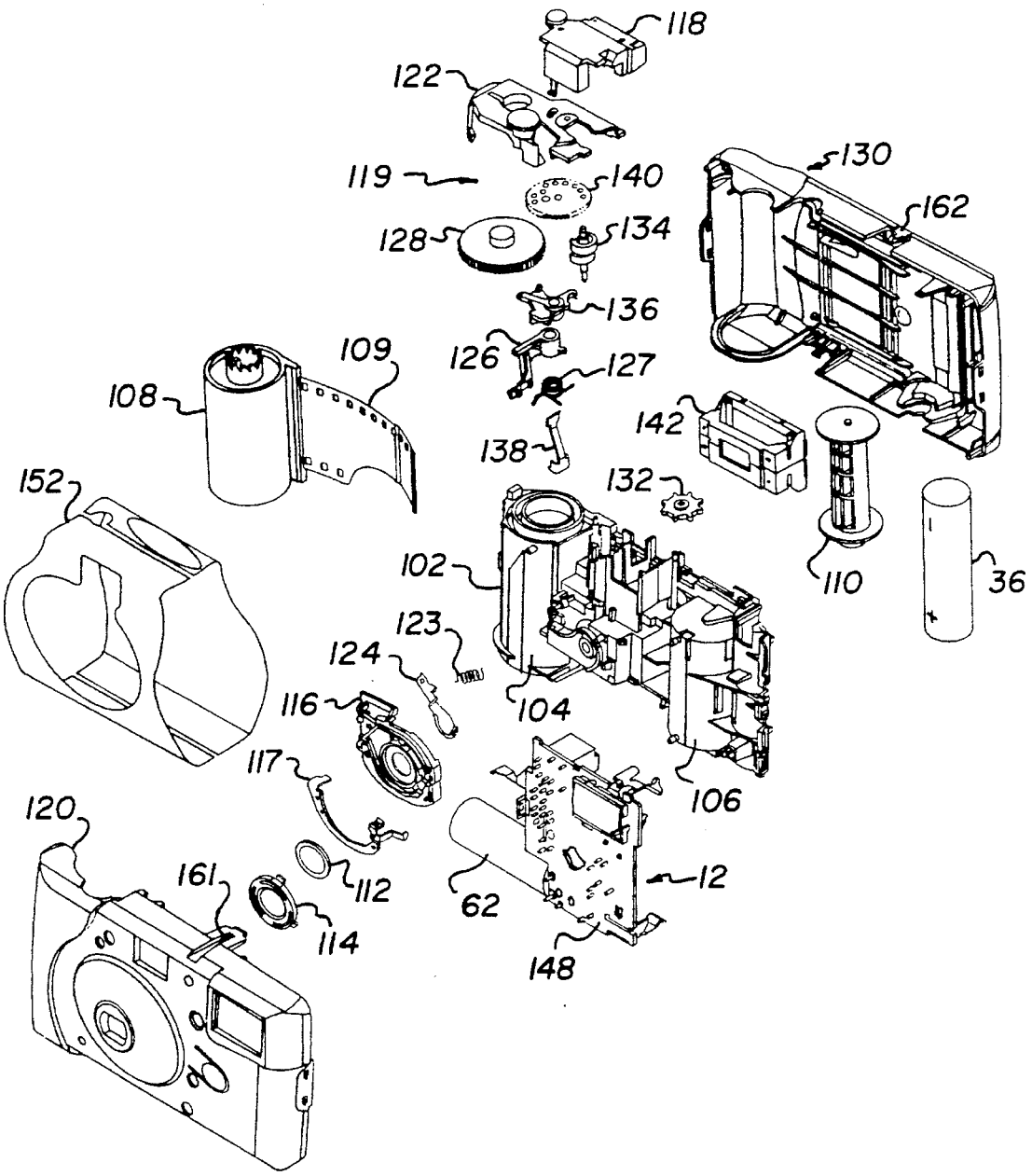
FIG. 3 is an exploded perspective view of a recyclable single use camera utilizing the flash charging and control circuit of FIG. 1.
Figure 4:
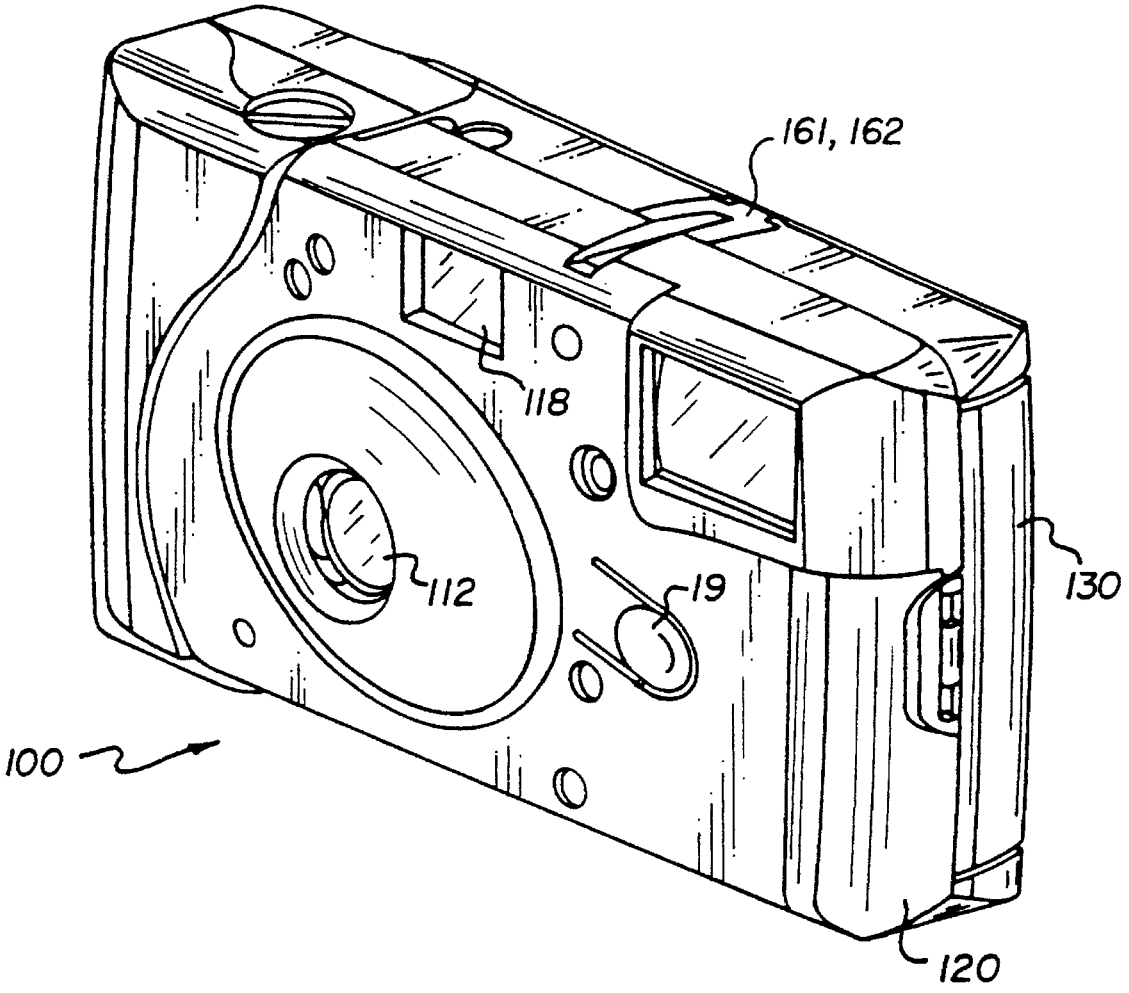
FIG. 4 is a front perspective view of the single use camera shown in FIG. 3.
Figure 5:
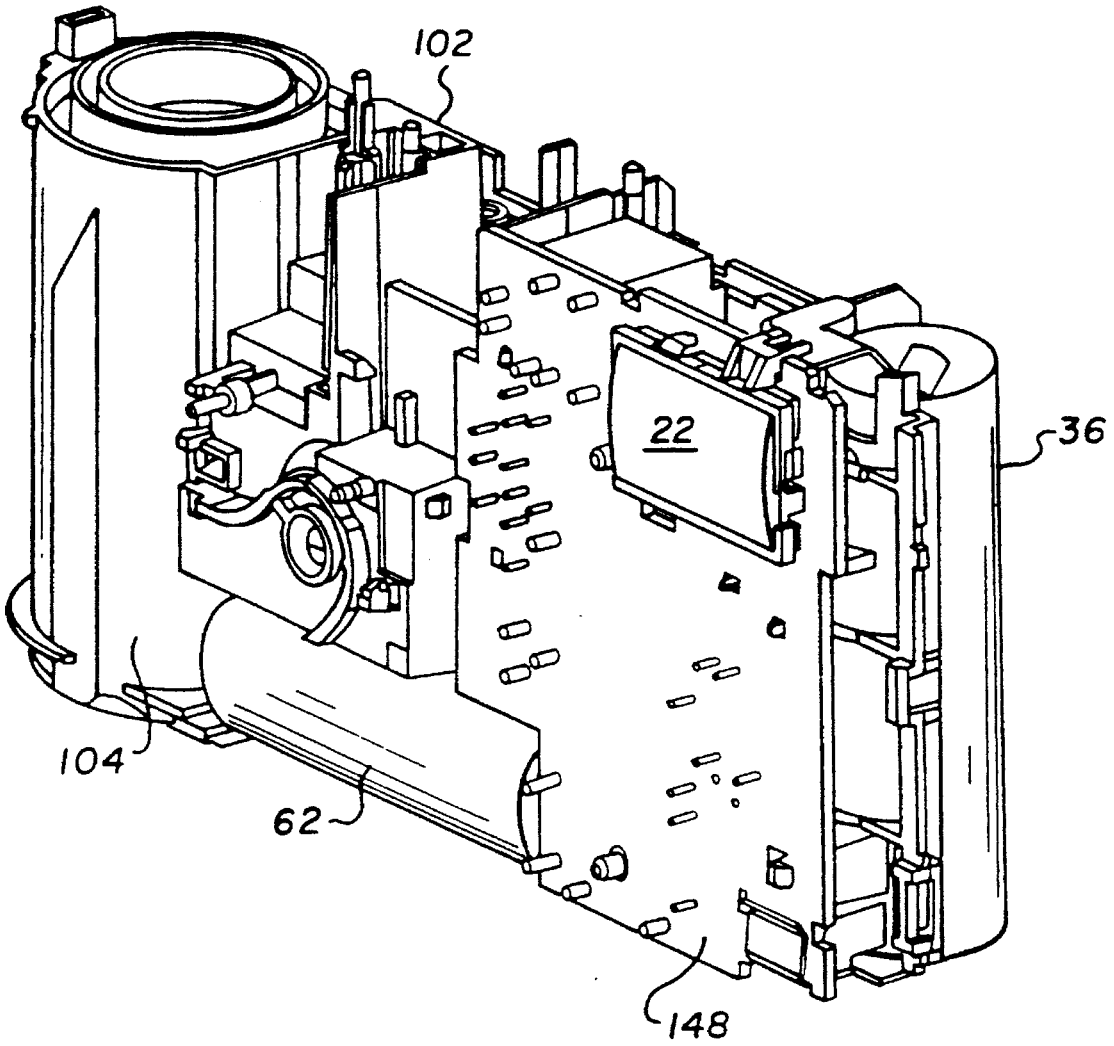
FIG. 5 is a partial front perspective view of the body of the single use camera shown in FIGS. 3 and 4.

Referring more specifically to the exploded view of camera 100 shown in FIG. 3, the body 102 includes a pair of formed chambers 104, 106 for respectively retaining a film cassette 108 and a take-up roll, such as spool 110. The pair of chambers 104, 106 are oppositely disposed relative to an exposure gate 107, FIG. 7. The body 102 additionally supports the following camera parts which are attached to the body prior to the attachment of the covers 120, 130: a taking lens 112 which is attached to the front of the body 102 by means of a retainer 114 and a support plate 116 sandwiching the lens therebetween; wherein the support plate has a contact switch 117; and a plastic viewfinder 118. The viewfinder 118 may be a one-piece viewfinder comprising a support and two optically aligned lenses, all of which may be molded together from a common material in a single molding process in accordance with the invention disclosed in commonly owned U.S. Pat. No. 5,353,165. The disclosure of this patent is incorporated by reference herein. Also attached to the body 102 is: a shutter mechanism 119 consisting of a keeper plate 122 having a depressible shutter release portion for tripping a shutter blade 124, biased by a spring 123 via a high-energy lever 126, which is also biased by helical spring 127; a film advancing and metering mechanism consisting of a thumbwheel 128 which engages the spool (not shown) of the loaded film cassette 108, a sprocket 132 for engaging film perforations having a spring biased portion extending into a rotable cam 134 which engages a metering lever 136 which is biased by means of a spring 138, the cam having an extending portion for contacting a frame counter 140; a light baffle 142 which is mounted into the rear of the body 102 and into the exposure gate 107, FIG. 7, or alternatively integrally formed with the body 102; and the previously described flash charging and control circuit 12, including capacitor 62, mounted on the back side of a circuit board 148 which is powered by a battery 36. The flash charging and control circuit 12 is made operable, preferably according to this particular embodiment, by a one touch cantilevered portion 19 of the front cover 102, FIG. 4. The flash assembly may include an anamorphic lens 22 (FIG. 5) as disclosed in the commonly assigned utility patent application referred to above, the disclosure of which is incorporated by reference herein. The front cover 120 and the rear cover 130 are sandwiched and held together along with the body 102, by means discussed subsequently, to form an assembled camera. A decorative label 152 may be subsequently attached to the finished camera 100 to deter a user from opening the camera and provide a convenient place for product identification and operational information.

For a variety of reasons, including economic efficiency and environmental concerns, single use cameras, such as the described camera 100, are designed to be recycled by the manufacturer after a purchaser has completed exposing the loaded film and turned the camera over to a photofinisher for development of the film. See, for instance, Sakai, et al. U.S. Pat. No. 5,329,330. Therefore, certain parts of the cameras are designed to last through a suitable number of cycles of sale, use, reconstruction, and resale. Conversely, for quality reasons, among others, certain parts should be replaced each time a camera is reconstructed. To successfully recycle cameras, it is important to know when particular reused camera parts should no longer be utilized because, for example, they have reached the end of their useful life. Thus, each time a camera is recycled, as described in detail below, a mark on the camera body and/or flash mechanism may be made in accordance with commonly owned U.S. Pat. No. 5,021,811 (the disclosure of which is incorporated by reference herein) to indicate the number of times it has been reconstructed.

Figure 6:
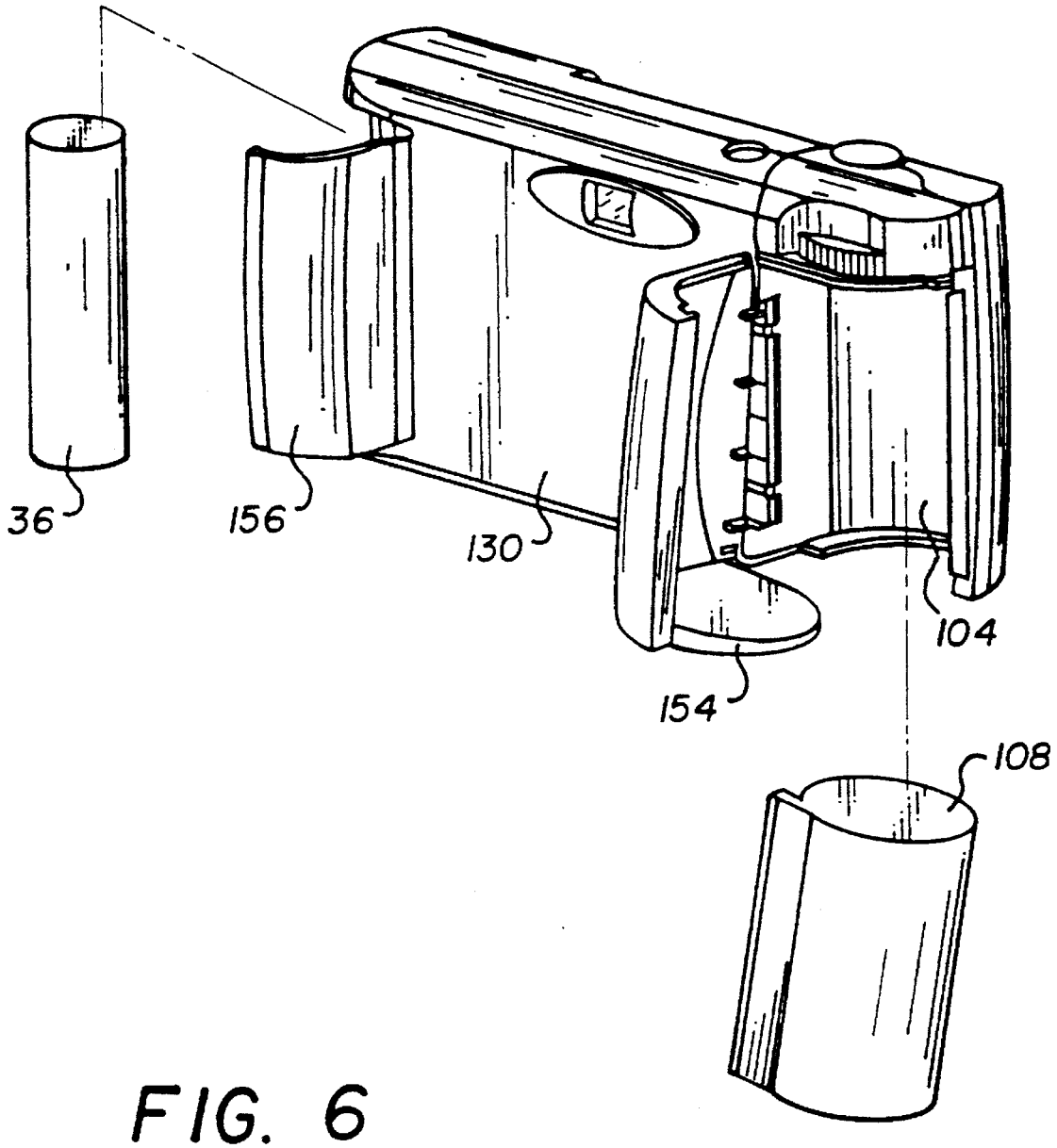
FIG. 6 is a partially exploded rear view of the camera shown in FIGS. 3–5.
Figure 7:
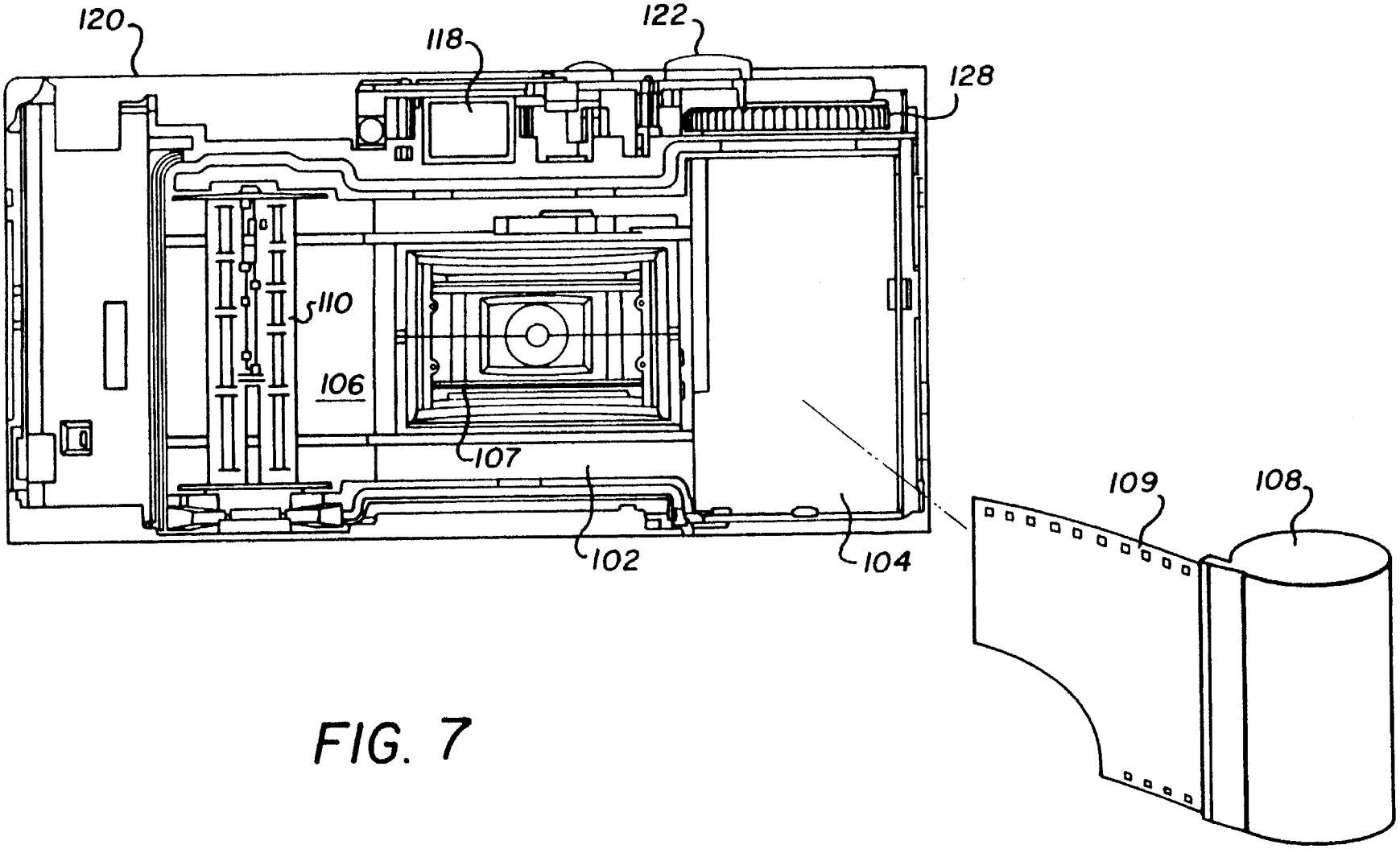
FIG. 7 is a partial rear view of the single use camera of FIG. 6 showing the reloading of a film cassette.

An efficient recycling program requires a number of competing concerns to be reconciled. In general, the manufacturer/recycler wants to facilitate easy access to the exposed film when removed by the photofinisher. This ensures that the reusable components are not damaged. On the other hand, access to the interior of the camera by the consumer/photographer is undesirable because it increases the risk of damage to and/or contamination of the interior of the camera and its reusable components. These considerations are resolved by the particular design of the door 154 provided on the rear cover, as shown in FIG. 6, to access the film chamber 104. To facilitate recycling without damage to the camera, the door 154 may be attached to the rear cover by a living or flexible hinge integrally formed as a groove or a reduced thickness portion of the cover. An example of a living hinge in a film cassette door for a single use camera is disclosed in commonly owned U.S. Pat. No. 5,255,041, the disclosure of which is incorporated by reference herein. Alternatively, the door 154 may be connected to the rear cover by a frangible connection integrally formed therewith and designed to break away from the remainder of the rear cover. In either case, the opening of the door 154 provides access to film cassette 108 without damaging or exposing the camera parts attached to the camera body 102. Similarly, a second door 156 can also be provided on the rear cover 130 to be flexibly opened or broken away by the photofinisher to remove the flash battery 36, if desired. See FIG. 6.

The camera 100 is then turned over to the manufacturer for recycling as will now be described with reference to the FIGS. 3–7. The recycling process may comprise the following steps: First, the front cover 120 and rear cover 130 may be detached from the camera body 102. It should be readily apparent that the covers 120, 130 and body 102 may utilize a number of means for attaching the structural parts together; for example, hook and/or press fitting members may be used, or the parts can be ultrasonically welded together. Thus, each cover may have a suitable number of conventional releasable hook structures (one of which is shown at 161, 162) or other attachment means for allowing removal of the covers from the body. The covers may be made from a recyclable plastic such as polystyrene and can be sent to be pulverized. The pulverized material may be blended with virgin materials and new covers or other parts molded therefrom.

The prewind spool 110, the taking lens 112, and light baffle 142 (unless integrally molded with the body 102) also are removed. The taking lens 112 also may be similarly pulverized with other lenses, blended with virgin materials, and new lenses made therefrom.

Other parts, typically more costly components designed to be reused, such as the main body 102 and the major parts supported by the body, e.g., the viewfinder 118, shutter mechanism 119, film advancing and metering mechanism, and flashing charging and control circuit 12 may be examined carefully for wear or damage. Those parts deemed damaged or worn may be removed from the body 102 and replaced with new parts. Those remaining reusable parts, such as the camera flash charging and control circuit 12, shutter mechanism 119, etc., that can be reused remain supported by the camera body, for construction into a camera 100.

A new front cover 120 is then fitted to the front face of the body 102 and an unexposed roll of film 109 contained within a fresh cassette 108 is loaded into the film cartridge chamber 104. A leading portion of the film 109 contained with the cassette 108 is then engaged with the take up spool 110, housed within the body chamber 106, as is conventionally known. A new rear cover 130 is then snapped or otherwise attached onto the rear of the camera body 102 and/or to the front cover 120 by any of the attachment means discussed above.

A less rigorous but not preferred recycling process may be employed in which the covers 120, 130 are not replaced with new parts. In this case, the cameras would be inspected visually after the back cover is removed. If the camera was deemed reusable as a whole, a new film 109 then would be reloaded into the film chamber and threaded onto the take-up spool. The rear cover then would be re-attached to the camera body and/or front cover.

In either case, the film 109 may be then prewound onto the take-up spool 110, which is supported for rotation in chamber 106 so that the film is wound back into the cassette 108 as the film is being exposed. A limited torque electric screwdriver or other tool may be used to prewind the film onto the prewind spool. If a new take-up spool is not provided and if the exposed end of the prewind spool previously was deformed to prevent reuse of the spool for prewinding purposes, sufficient heat and/or pressure must be applied to rotate the spool.

At least one wind and trip check (film advance and shutter actuation) may be done to simulate taking a picture, thereby bringing the counter down to 24 (assuming a 24 exposure roll). The camera then may be inserted into a cardboard casing or a label such as 152 attached thereto by adhesive. The recycled camera then may be humidity sealed in a foil wrap, plastic bag or the like, and packaged in an outer cardboard box for sale. The recycled single use camera 100, utilizing previously used single use camera parts, such as the flash charging and control circuit 12, is now fully assembled and ready for consumer use.

While the invention is described in connection with a preferred embodiment, other modifications and applications will occur to those skilled in the art. The claims should by interpreted to fairly cover all such modifications and applications within the true spirit and scope of the invention.

PARTS LIST FOR FIGS. 1–7

| | |
|---|---|
| 10 | Camera. |
| 12 | Flash charging and control circuit. |
| 14 | Camera body. |
| 16 | Optical system. |
| 18,19 | Actuating mechanisms. |
| 20 | Viewfinder. |
| 22 | Flash device. |
| 24 | Flash tube. |
| 26 | Power source. |
| 28 | Self-oscillating flash charging circuit. |
| 30 | Capacitor. |
| 32 | Oscillation arresting circuit. |
| 34 | Flash trigger circuit. |
| 36 | Batteries. |
| 38 | Primary transformer winding. |

-continued

PARTS LIST FOR FIGS. 1–7

| | |
|---|---|
| 40 | Secondary transformer winding. |
| 42 | Momentary switch. |
| 44 | Resistor. |
| 46 | Transistor. |
| 47 | Capacitor. |
| 48 | Transistor. |
| 50 | Rectifying diode. |
| 52 | Voltage sensor. |
| 54 | Digital transistor. |
| 56 | Neon ready light. |
| 58 | Zener diode. |
| 62 | Triggering capacitor. |
| 64 | Transformer. |
| 66 | Flash triggering electrode. |
| 68 | Synchronizing switch. |
| 100 | Single-use camera. |
| 102 | Body. |
| 104 | Film cassette chamber. |
| 106 | Take-up chamber. |
| 107 | Exposure gate. |
| 108 | Film cassette. |
| 109 | Film. |
| 110 | Take-up spool. |
| 112 | Taking lens. |
| 114 | Retainer. |
| 116 | Support plate. |
| 118 | Viewfinder. |
| 119 | Shutter mechanism. |
| 120 | Front cover. |
| 122 | Keeper plate. |
| 123 | Spring. |
| 124 | Shutter blade. |
| 126 | High energy lever. |
| 127 | Helical spring. |
| 128 | Thumb wheel. |
| 130 | Rear cover. |
| 132 | Sprocket. |
| 134 | Rotatable cam. |
| 136 | Metering lever. |
| 138 | Spring. |
| 140 | Frame counter. |
| 142 | Baffle. |
| 148 | Circuit board. |
| 152 | Label. |
| 154 | First door. |
| 156 | Second door. |

What is claimed is:

1. A flash device including an illumination element, a flash capacitor providing energy to illuminate said element, a self-oscillating circuit for charging said capacitor, and an electrically actuated gate separate from the self-oscillating circuit for arresting oscillations in said circuit; characterized in that:

a conductive path provided between said flash capacitor and said gate separate from said self-oscillating circuit includes a trigger responsive to a charge level on said capacitor for enabling at least momentary conduction in said path to actuate said gate and arrest said oscillations; and including an oscillation trigger responsive to a momentary actuation for initiating oscillations in said self-oscillating circuit.

2. The invention of claim 1, wherein said oscillation trigger is a manually actuated switch, said gate is a transistor for grounding said oscillating circuit, and said grounding overrides said switch to arrest said oscillations when said switch is held on.

3. The invention of claim 1, wherein said oscillation arresting trigger includes a zener diode.

4. An electronic flash device including a direct current power source, a capacitor, a self-oscillating charging circuit for charging said capacitor from said power source and including a momentary trigger for initiating oscillations in the charging circuit; characterized in that:

a switch coupled to said charging circuit is actuatable to arrest said oscillations; and, a voltage sensor coupled in series between said capacitor and said switch actuates said switch to arrest said oscillations in response to a predetermined charge level on said capacitor.

5. The invention of claim 4, wherein said voltage sensor includes a zener diode in series with a neon ready light.

6. The invention of claim 4, wherein said switch includes a transistor for grounding said charging circuit, and said voltage sensor is a zener diode and a neon ready light, that conduct momentarily, turning on said transistor and grounding said circuit.

7. An electronic flash device including an illumination element, an actuation circuit having a capacitor providing energy releasable to illuminate said element, and a self-oscillating charging circuit for charging said capacitor; characterized in that:

an oscillation arresting circuit is responsive to a voltage level on said capacitor for arresting oscillations in said circuit; and, a feedback loop reinitiates said oscillations in response to said energy release in said actuation circuit.

8. The invention of claim 7, wherein said self-oscillating charging circuit includes a transformer having primary and secondary windings, and said feedback loop includes said secondary windings and an amplification element between said secondary windings and said primary windings.

9. An electronic flash device comprising:

a flash tube for providing scene illumination;

a flash actuation circuit coupled to said flash tube and including a storage device for storing and applying energy to said flash tube to illuminate said tube;

a self-oscillating charging circuit for charging said storage device; and, an oscillation initiation feedback loop for initiating oscillations in said charging circuit in response to said energy application by said actuation circuit wherein said self-oscillating charging circuit includes a transformer having primary windings and secondary windings for charging said flash capacitor and an amplified feed-back loop including first and second ganged transistors coupled between said secondary windings and said primary windings for supporting and maintaining oscillations in said self-oscillating circuit; and said oscillation initiation feedback loop is coupled to said ganged transistors for utilizing current gain in said ganged transistors to initiate oscillations in response to said energy application by said actuation circuit.

10. An electronic flash device comprising:

a flash tube for providing illumination;

a flash capacitor dischargeable through said flash tube for providing energy to illuminate said tube;

a self-oscillating charging circuit coupled to said flash capacitor for charging said flash capacitor, said self-oscillating charging circuit including a transformer having primary windings and secondary windings for charging said capacitor and an amplified feed-back loop between said secondary windings and said primary windings for sustaining oscillations in said self-oscillating circuit; and, an oscillation arresting circuit coupled between said self-oscillating circuit and said flash capacitor and responsive to voltage on said capacitor for arresting said oscillations when said capacitor is fully charged;

said feedback loop reinitiating said oscillations in response to discharge of said capacitor through said illumination element.

11. An electronic flash device including a flash capacitor for providing energy to illuminate a scene, a charging circuit for charging said capacitor to a predetermined voltage greater than flash ready voltage, and an automatic trigger circuit for triggering said charging circuit off; characterized in that:

said trigger circuit includes a neon ready light operative as a charge voltage indicator for conducting when said capacitor voltage exceeds said ready voltage, and as a voltage sensing component for triggering said charging circuit off when said capacitor voltage exceeds said predetermined voltage.

12. An electronic flash device including a flash capacitor providing energy for illuminating a scene, a charging circuit for charging the capacitor to a predetermined charge, and a neon ready light for indicating a ready charge on said capacitor less than said predetermined charge; characterized in that:

said neon light forms part of first and second electrical loops, said first loop conducting continuously when said capacitor charge is above said ready charge, said second loop including means for controlling said charging circuit and conducting momentarily to trigger said charging circuit off when said capacitor charge reaches said predetermined charge.

13. The invention of claim 12, wherein said momentary conduction momentarily increases the illumination of said ready light to indicate said predetermined charge.

14. An electronic flash device including a flash actuation circuit for applying energy to a flash tube to illuminate said tube, and a charging circuit that oscillates to charge said actuation circuit with said energy; characterized in that:

a feedback loop initiates oscillations in said charging circuit in response to said energy application by said actuation circuit, and a capacitor between said oscillating circuit and ground filters perturbations in said charging circuit substantially smaller than said energy application to dampen out oscillations from battery bounce, and the like.

15. The invention of claim 14, wherein said capacitor has a value in the range of two hundred pico farads to one thousand pico farads.

16. The invention of claim 15, wherein said capacitor has a value of approximately four hundred and seventy pico farads.

17. A single use electronic flash camera made from previously used single use camera parts, comprising:

a camera body having a film cassette chamber, said camera body supporting previously used single use camera parts including an electronic flash device including a capacitor, a self-oscillating charging circuit coupled to the capacitor for charging said capacitor, a trigger connected to said self-oscillating charging circuit which, when momentarily closed, initiates oscillations in said self-oscillating charging circuit, said oscillations continuing when said trigger is opened, a switch operable to arrest said oscillations, and a voltage sensor coupled between said switch and capacitor and responsive to the voltage on said capacitor for activating said switch to arrest said oscillations when said capacitor is fully charged, said switch and said voltage sensor being separate from said self-oscillating charging circuit; and an unexposed roll of film mounted in the film cassette chamber of the camera body.

18. The single use camera of claim 17, wherein the camera body further comprises a take-up roll supported for rotation within the body, and the film is prewound onto the take-up roll.

19. The single use camera of claim 18, wherein said camera body further supports at least one previously used single use camera part selected from the group consisting of a viewfinder, taking lens, shutter mechanism, and film advance and metering mechanism.

20. A method of recycling a single use camera with an electronic flash from previously used single use camera parts, comprising the steps of:

providing a previously used camera body having a film cassette chamber;

supporting in the camera body previously used single use camera parts including an electronic flash device having a capacitor, a self-oscillating charging circuit coupled to the capacitor for charging the capacitor, a trigger connected to the self-oscillating charging circuit which, when momentarily closed, initiates oscillations in the self-oscillating charging circuit, the oscillations continuing when the trigger is opened, a switch operable to arrest the oscillations, and a voltage sensor coupled between the switch and the capacitor for activating the switch to arrest the oscillations when the capacitor is fully charged, said switch and said voltage sensor being separate from said self-oscillating charging circuit; and loading an unexposed roll of film into the film cassette chamber of the camera body.

21. The method of claim 20, wherein the camera body includes a take-up roll supported for rotation within the body, and further comprising the step of prewinding the film onto the take-up roll.

22. The method of claim 21 wherein the take-up roll is a previously used part and the step of prewinding the film onto the take-up roll comprises using a tool to apply sufficient force to rotate the roll within the body.

23. The method of claim 20, further comprising the step of:

determining which, if any, of the previously used camera components must be replaced with new parts.

24. The method of claim 23, further comprising the steps of:

supporting the camera body within a previously used front cover and rear cover; and attaching a paper-based material around the covers.

25. The method of claim 20, wherein the single use camera includes a front cover and a rear cover surrounding the camera body and the step of providing a previously used camera body comprises removing at least one of the front and rear covers from the camera.

26. The method of claim 25, further comprising the steps of:

removing the take-up roll and taking lens from the previously used camera body and replacing them with corresponding new parts;

replacing, if necessary, previously used parts selected from the group consisting of the camera body, shutter mechanism, and film advance and metering mechanism with corresponding new parts; and attaching, as necessary, a new front cover and a new rear cover to the camera body.

27. The method of claim 26, further comprising the steps of:

performing at least one wind and trip check by advancing the unexposed roll of film and activating the shutter.

28. The method of claim 27, further composing the steps of:

attaching a paper-based material around the front and rear covers; and sealing the recycled camera in a bag to preserve the unexposed roll of film loaded therein.

* * * * *